US010816227B2

(12) United States Patent
Otsuka et al.

(10) Patent No.: US 10,816,227 B2
(45) Date of Patent: Oct. 27, 2020

(54) OUTDOOR UNIT FOR AN AIR-CONDITIONING APPARATUS HAVING L-SHAPED HEAT EXCHANGER AND PLACEMENT PLATE FOR SAME

(71) Applicant: Mitsubishi Electric Corporation, Tokyo (JP)

(72) Inventors: Motoki Otsuka, Tokyo (JP); Yohei Kato, Tokyo (JP); Yudai Sakabe, Tokyo (JP); Tsubasa Tanda, Tokyo (JP); Masaharu Miwa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 8 days.

(21) Appl. No.: 16/096,087

(22) PCT Filed: Jul. 25, 2016

(86) PCT No.: PCT/JP2016/071681
§ 371 (c)(1),
(2) Date: Oct. 24, 2018

(87) PCT Pub. No.: WO2018/020536
PCT Pub. Date: Feb. 1, 2018

(65) Prior Publication Data

US 2019/0137118 A1 May 9, 2019

(51) Int. Cl.
*F24F 1/16* (2011.01)
*F28F 17/00* (2006.01)
(Continued)

(52) U.S. Cl.
CPC ..... *F24F 1/16* (2013.01); *F28D 1/0477* (2013.01); *F28F 9/0131* (2013.01);
(Continued)

(58) Field of Classification Search
CPC .... F24F 1/16; F24F 13/222; F24F 1/36; F28F 19/00; F28F 21/084; F28F 9/0131;
(Continued)

(56) References Cited

U.S. PATENT DOCUMENTS 4,748,828 A * 6/1988 Chang ..... F24F 1/36 62/272
6,802,361 B2 * 10/2004 Hatanaka ..... F24F 1/0011 165/53
(Continued)

FOREIGN PATENT DOCUMENTS

EP 2 754 974 A2 7/2014
JP 2005-114273 A 4/2005
(Continued)

OTHER PUBLICATIONS

International Search Report of the International Searching Authority dated Oct. 11, 2016 for the corresponding international application No. PCT/JP2016/071681 (and English translation).
(Continued)

*Primary Examiner* — Ljiljana V. Ciric
(74) *Attorney, Agent, or Firm* — Posz Law Group, PLC

(57) ABSTRACT

An outdoor unit for an air-conditioning apparatus that includes a bottom plate made of metal, an L-shaped heat exchanger made of metal different than the metal of the bottom plate, a placement plate provided on the bottom plate and having a heat exchanger placement surface on which the heat exchanger is placed. The placement plate having an L-shape in plan view, and the placement plate is held in contact with the bottom plate only below each of a short-side end portion of the placement plate, a long-side end portion of the placement plate, and a corner portion of the placement plate.

17 Claims, 8 Drawing Sheets

(51) Int. Cl.

| | |
|---|---|
| ***F28F 21/08*** | (2006.01) |
| ***F28F 9/013*** | (2006.01) |
| ***F28D 1/047*** | (2006.01) |
| ***F28F 19/00*** | (2006.01) |
| ***F24F 1/38*** | (2011.01) |
| ***F24F 13/22*** | (2006.01) |
| *F24F 1/36* | (2011.01) |

(52) U.S. Cl.
CPC ..... *F28F 17/005* (2013.01); *F28F 19/00* (2013.01); *F28F 19/002* (2013.01); *F28F 21/082* (2013.01); *F28F 21/084* (2013.01); *F24F 1/36* (2013.01); *F24F 13/222* (2013.01)

(58) Field of Classification Search
CPC ..... F28F 21/082; F28F 19/002; F28F 17/005; F28D 1/0477
See application file for complete search history.

(56) References Cited

U.S. PATENT DOCUMENTS

| | | | | |
|---|---|---|---|---|
| 7,708,052 | B2 * | 5/2010 | Leman | F24F 1/36 165/78 |
| 10,215,507 | B2 * | 2/2019 | Mastroianni | F28F 9/001 |
| 2002/0134099 | A1 * | 9/2002 | Mochizuki | F24F 1/46 62/285 |
| 2002/0162207 | A1 * | 11/2002 | Yotsumoto | B02C 13/28 29/426.4 |
| 2006/0130516 | A1 * | 6/2006 | Sugiyama | F24F 1/46 62/507 |
| 2009/0158765 | A1 * | 6/2009 | Ooishi | F24F 1/0057 62/263 |
| 2010/0226104 | A1 * | 9/2010 | Takeichi | F24F 1/22 361/752 |
| 2010/0294466 | A1 * | 11/2010 | Shimaoka | F24F 1/54 165/104.33 |
| 2011/0154846 | A1 * | 6/2011 | Marega | F25D 23/006 62/291 |
| 2012/0274188 | A1 * | 11/2012 | Shiborino | F24F 1/56 312/100 |
| 2013/0037239 | A1 * | 2/2013 | Shiborino | F28D 1/0435 165/67 |
| 2013/0214635 | A1 * | 8/2013 | Yabe | H02K 17/20 310/197 |
| 2014/0091692 | A1 * | 4/2014 | Miwa | F24F 13/20 312/285 |
| 2014/0131024 | A1 * | 5/2014 | Iwazaki | F24F 1/06 165/185 |
| 2015/0027670 | A1 * | 1/2015 | Jinnai | F24F 1/38 165/121 |
| 2015/0060029 | A1 * | 3/2015 | Ono | F24F 1/40 165/162 |
| 2016/0131371 | A1 * | 5/2016 | Aoyama | F24F 1/56 165/122 |
| 2016/0334156 | A1 * | 11/2016 | Kawabata | F28F 1/126 |
| 2017/0248329 | A1 * | 8/2017 | Inada | F24F 1/22 |
| 2017/0314791 | A1 * | 11/2017 | Yanase | F24F 13/222 |
| 2017/0328587 | A1 * | 11/2017 | Kubono | F24F 1/56 |
| 2017/0370605 | A1 * | 12/2017 | Makino | F24F 11/77 |
| 2018/0051895 | A1 * | 2/2018 | Morioka | F24F 1/0007 |
| 2019/0128542 | A1 * | 5/2019 | Furukubo | F24F 1/56 |
| 2019/0212018 | A1 * | 7/2019 | Kim | F24F 1/00073 |
| 2019/0264929 | A1 * | 8/2019 | Yanase | F24F 1/38 |
| 2019/0271477 | A1 * | 9/2019 | Takeuchi | F24F 1/22 |
| 2020/0088422 | A1 * | 3/2020 | Ogawa | F28D 1/05383 |

FOREIGN PATENT DOCUMENTS

| | | | |
|---|---|---|---|
| JP | 2010-151387 | A | 7/2010 |
| JP | 2010-164263 | A | 7/2010 |
| JP | 2014-137155 | A | 7/2014 |
| JP | 2014-137157 | A | 7/2014 |
| JP | 2016-014505 | A | 1/2016 |
| JP | 2016-084995 | A | 5/2016 |

OTHER PUBLICATIONS

Office Action dated Apr. 13, 2020 issued in corresponding CN patent application No. 201680087032.7 (and English translation).
Office Action dated Jun. 8, 2020 issued in corresponding CN patent application No. 201680087032.7 (and English translation).

* cited by examiner

OUTDOOR UNIT FOR AN AIR-CONDITIONING APPARATUS HAVING L-SHAPED HEAT EXCHANGER AND PLACEMENT PLATE FOR SAME

CROSS REFERENCE TO RELATED APPLICATION

This application is a U.S. national stage application of International Application No. PCT/JP2016/071681, filed on Jul. 25, 2016, the contents of which are incorporated herein by reference.

TECHNICAL FIELD

The present invention relates to an outdoor unit for an air-conditioning apparatus to which a heat exchanger is mounted.

BACKGROUND

Hitherto, a heat exchanger mounted to an outdoor unit for an air-conditioning apparatus is directly placed on a bottom plate of a casing of the outdoor unit. In such a structure, when aluminum is used as a material of the heat exchanger, and iron is used as a material of the bottom plate, dissimilar metal contact corrosion may occur. Copper has hitherto been used as a material of a refrigerant pipe of the heat exchanger. However, in recent years, there is an increasing tendency that a so-called all-aluminum heat exchanger using aluminum as a material of the refrigerant pipe is mounted to an outdoor unit for an air-conditioning apparatus. In the case of the all-aluminum heat exchanger, as compared to the heat exchanger using the refrigerant pipe made of copper, leakage of refrigerant due to the dissimilar metal contact corrosion is more liable to occur. As a measure of suppressing the dissimilar metal contact corrosion, for example, in Patent Literature 1, there is disclosed a configuration in which spacers made of metal that is electrically less noble than aluminum are arranged between a bottom plate and a heat exchanger.

PATENT LITERATURE

Patent Literature 1: Japanese Unexamined Patent Application Publication No. 2005-114273

According to the configuration disclosed in Patent Literature 1, the bottom plate and a bottom surface of the heat exchanger are connected to each other through intermediation of two spacers each having a rectangular parallelepiped shape. In the case of such a configuration, there has been a problem in that, when water and dust generated in the casing of the outdoor unit adhere to the spacers, the heat exchanger and the bottom plate are electrically connected to each other through intermediation of the water and dust, with the result that the dissimilar metal contact corrosion may occur. Further, there has also been a problem in that, when the water and dust once adhere to the spacers, those adhering matters remain at the spacers, with the result that the dissimilar metal contact corrosion is promoted. Further, there has also been a problem in that, when a mixture of the water and dust is accumulated on the bottom plate between the two spacers to reach the bottom surface of the heat exchanger, the bottom plate and the heat exchanger bottom surface are electrically connected to each other through intermediation of the accumulated matters.

SUMMARY

The present invention has been made to solve the above-mentioned problems, and has an object to propose an outdoor unit for an air-conditioning apparatus, which prevents occurrence of the dissimilar metal contact corrosion in a heat exchanger.

According to one embodiment of the present invention, there is provided an outdoor unit for an air-conditioning apparatus, including: a bottom plate made of metal; a heat exchanger made of metal different from the metal of the bottom plate; and a placement plate, which is provided on the bottom plate and has a heat exchanger placement surface on which the heat exchanger is placed.

With the outdoor unit for an air-conditioning apparatus according to one embodiment of the present invention, the occurrence of the dissimilar metal contact corrosion in the heat exchanger can be prevented.

DETAILED DESCRIPTION

Embodiment 1

Now, with reference to the drawings, description is made of an outdoor unit 100 for an air-conditioning apparatus according to Embodiment 1 of the present invention.

Figure 1:
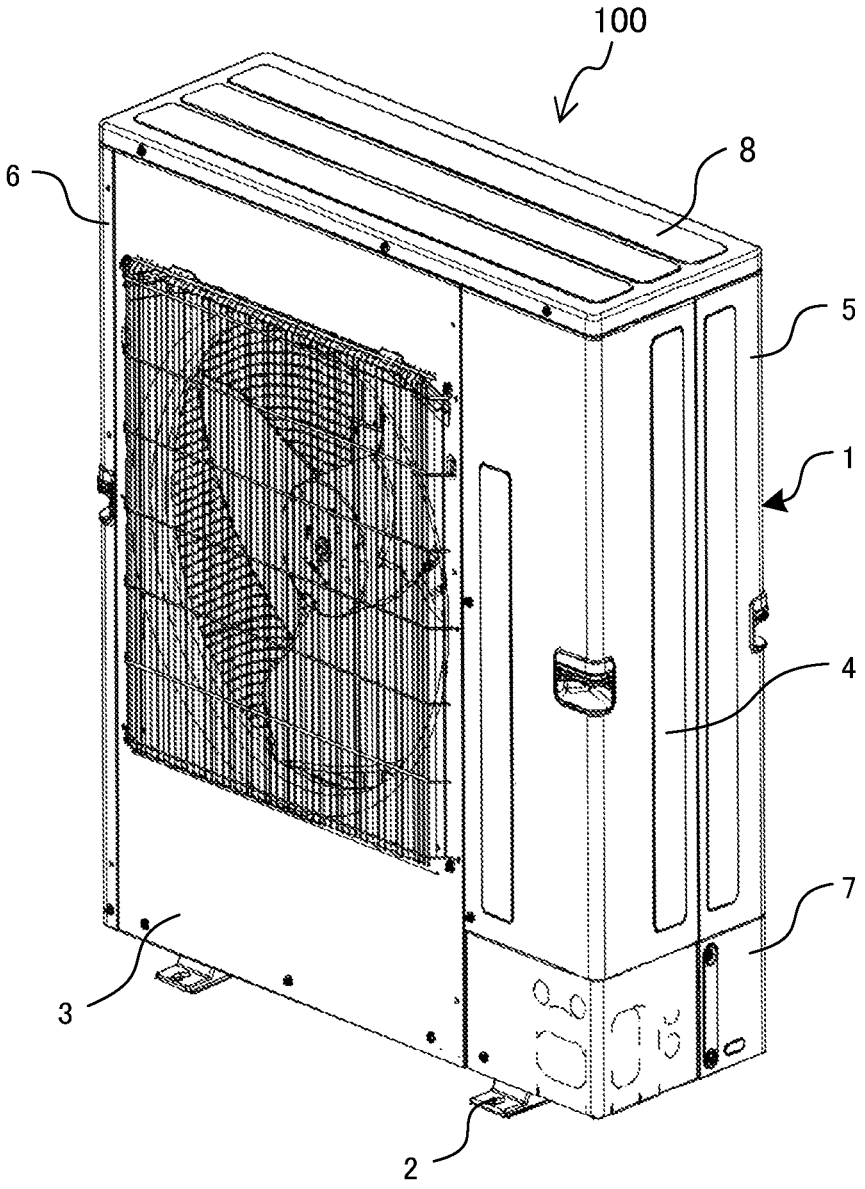
FIG. 1 is a perspective view for illustrating an outer appearance of an outdoor unit for an air-conditioning apparatus.

FIG. 1 is a perspective view for illustrating an outer appearance of the outdoor unit 100 for an air-conditioning apparatus. A casing 1 of the outdoor unit 100 includes a bottom plate 2, a front side panel 3, a service panel 4, a right side panel 5, a left side panel 6, a cover panel 7, and a top panel 8. The bottom plate 2 is a base pan forming a bottom portion of the casing 1. The front side panel 3 is provided on a front side. The service panel 4 partially covers the front side and a right side. The right side panel 5 is provided on the right side. The left side panel 6 is provided on the left side. The cover panel 7 covers a lower portion on the right side. The top panel 8 is provided on an upper side.

Figure 2:
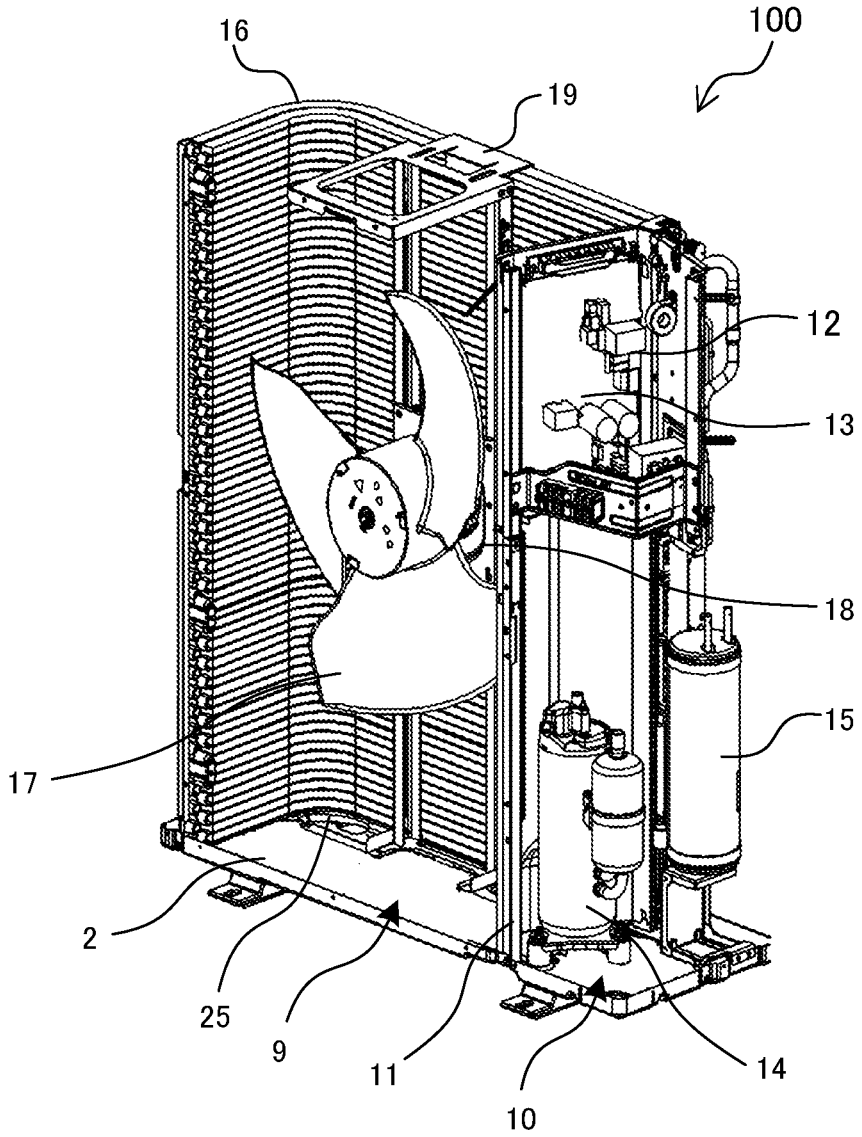
FIG. 2 is a perspective view for illustrating an inside of the outdoor unit for an air-conditioning apparatus of FIG. 1.

FIG. 2 is a perspective view for illustrating an inside of the outdoor unit 100. The inside of the outdoor unit 100 is separated by a separator 11 into an air-sending machine chamber 9 and a machine chamber 10.

In the air-sending machine chamber 9, there are provided a heat exchanger 16, a fan 17, a fan motor 18, a motor support 19, and a placement plate 25. The heat exchanger 16 has an L-shape in plan view. The fan 17 is configured to send air to the heat exchanger 16. The fan motor 18 is configured to drive the fan 17. The motor support 19 is configured to fix the fan motor 18. The placement plate 25 is provided on the bottom plate 2 and receives the heat exchanger 16.

In the machine chamber 10, there are provided an electrical component 12, an electrical component box 13, a compressor 14, and a pressure container 15. The electrical component 12 is configured to perform, for example, supply of power to components. The electrical component box 13 receives the electrical component 12. The compressor 14 is configured to compress refrigerant and feed the compressed refrigerant to a refrigerant pipe (not shown). Refrigerant having flowed in from the an indoor unit (not shown) including, for example, an indoor heat exchanger is compressed by the compressor 14, passes through the refrigerant pipe, and is fed to the heat exchanger 16 arranged in the air-sending machine chamber 9. A cooling function and a heating function are achieved by circulation of the refrigerant through the outdoor unit 100 and the indoor unit.

Figure 3:
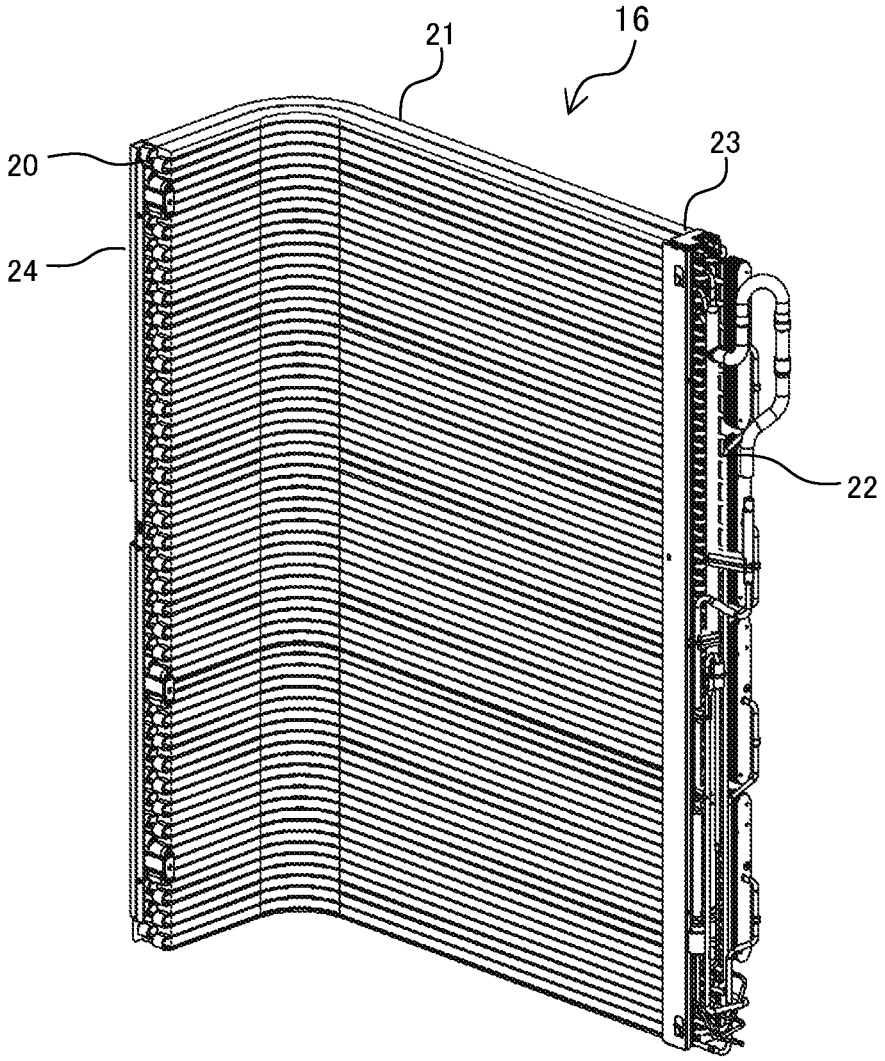
FIG. 3 is a perspective view of a heat exchanger of FIG. 2.

FIG. 3 is a perspective view of the heat exchanger 16. The heat exchanger 16 includes a flat tube 20, fins 21, a header pipe 22, and side plates 23 and 24. The flat tube 20 is a refrigerant pipe. The fins 21 receive air from the fan 17. The header pipe 22 is a refrigerant flow passage. The side plates 23 and 24 are mounted to both end portions of the fins 21. The heat exchanger 16 is placed on the placement plate 25 (see FIG. 6 to FIG. 11) provided on the bottom plate 2. The side plates 23 and 24 are fixed by screws to the casing 1 of the outdoor unit 100. Aluminum may be used as a material of each of the flat tube 20 and the fins 21.

Figure 4:
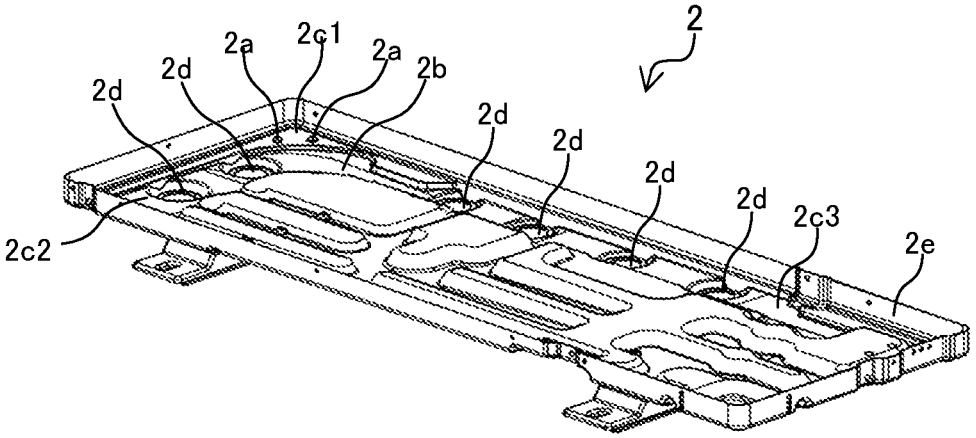
FIG. 4 is a perspective view of a bottom plate of FIG. 2.
Figure 5:
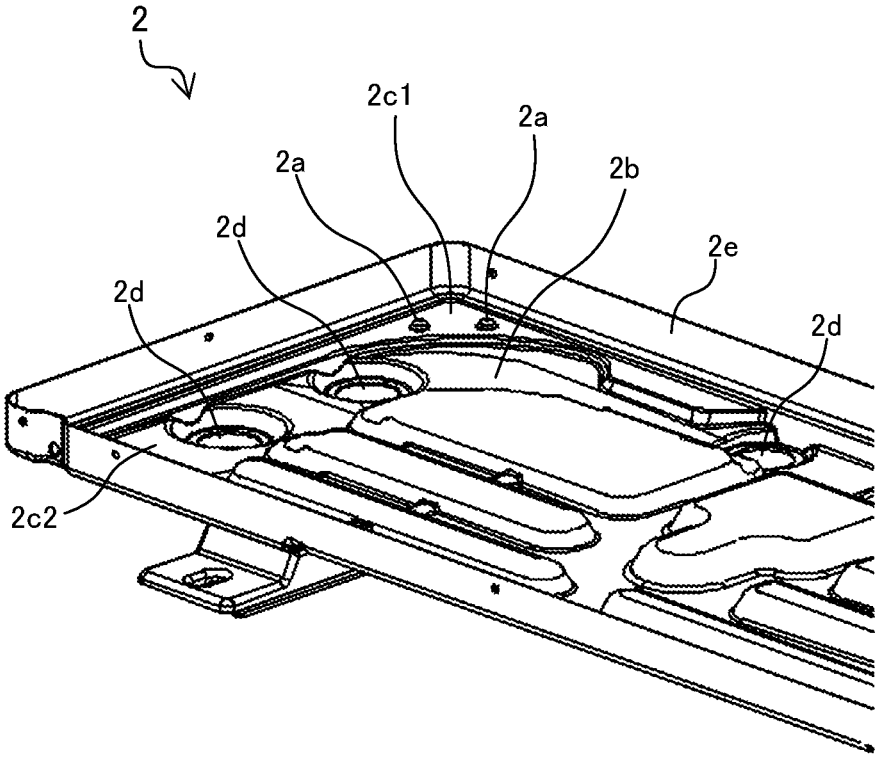
FIG. 5 is an enlarged perspective view for partially illustrating the bottom plate of FIG. 4.

FIG. 4 is a perspective view of the bottom plate 2. FIG. 5 is an enlarged perspective view for partially illustrating the bottom plate 2. The bottom plate 2 includes protruding portions 2*a*, a discharge passage 2*b*, a first support portion 2*c*1, a second support portion 2*c*2, a third support portion 2*c*3, discharge holes 2*d*, and a flange portion 2*e*. The protruding portions 2*a* are configured to position the placement plate 25 (see FIG. 6 to FIG. 11) provided on the bottom plate 2. The discharge passage 2*b* allows discharge of rain water and dust having entered the casing 1 and drain water generated by heat exchange (hereinafter referred to as water and dust generated in the casing 1). The first support portion 2*c*1 is configured to support a corner portion 25*j* of the placement plate 25 having an L-shape in plan view from a lower side. On the second support portion 2*c*2, a short-side end portion 25*h* of the placement plate 25 is placed. On the third support portion 2*c*3, a long-side end portion 25*i* of the placement plate 25 is placed. The discharge holes 2*d* allow drainage of the water and dust generated in the casing 1 to an outside of the casing 1. The flange portion 2*e* is configured to fix lower portions of the panels on the front, rear, right, and left sides of the casing 1.

The first support portion 2*c*1 is provided at one of four corners of the bottom plate 2 having a rectangular shape in plan view. The two protruding portions 2*a* are formed on the first support portion 2*c*1. The first support portion 2*c*1, the second support portion 2*c*2, and the third support portion 2*c*3 are arranged at positions higher than the discharge passage 2*b* and the discharge holes 2*d*. The discharge passage 2*b* has an L-shape in plan view, and a corner portion of the discharge passage 2*b* is positioned below the first support portion 2*c*1. A long side of the discharge passage 2*b* is formed on a back side in the casing 1 (FIG. 1), and a short side of the discharge passage 2*b* is formed on the left side in the casing 1. The discharge passage 2*b* can be formed by subjecting the bottom plate 2 to drawing. A plurality of discharge holes 2*d* are formed at intervals in the discharge passage 2*b*. The discharge holes 2*d* may be formed at, for example, the second support portion 2*c*2 other than the discharge passage 2*b*. The discharge holes 2*d* are each an opening having a circular shape in plan view. The flange portion 2*e* is provided along a peripheral edge of the bottom plate 2 and has an inner surface perpendicular to the bottom surface of the bottom plate 2. As a material of the bottom plate 2, there may be used a material that is electrically more noble than aluminum, that is, a material having a small ionization tendency. For example, an iron plate or a zinc-coated steel plate may be used.

Figure 6:
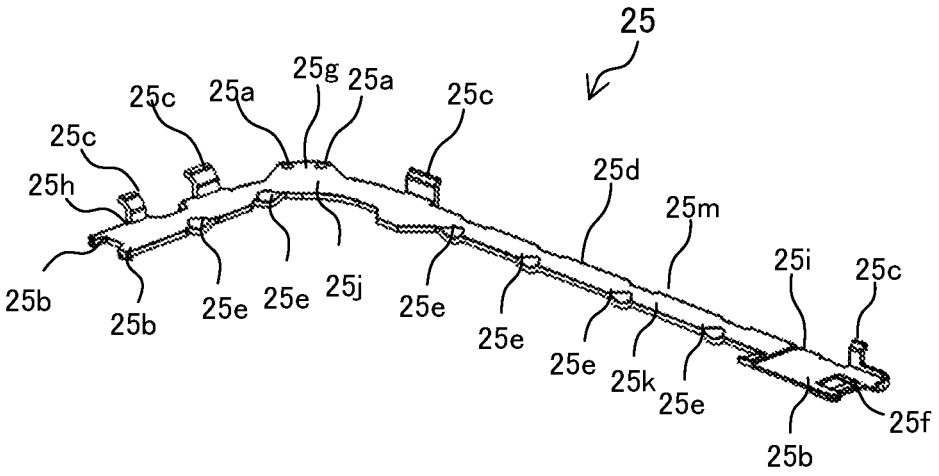
FIG. 6 is a perspective view of a placement plate mounted to the bottom plate of FIG. 4.
Figure 7:
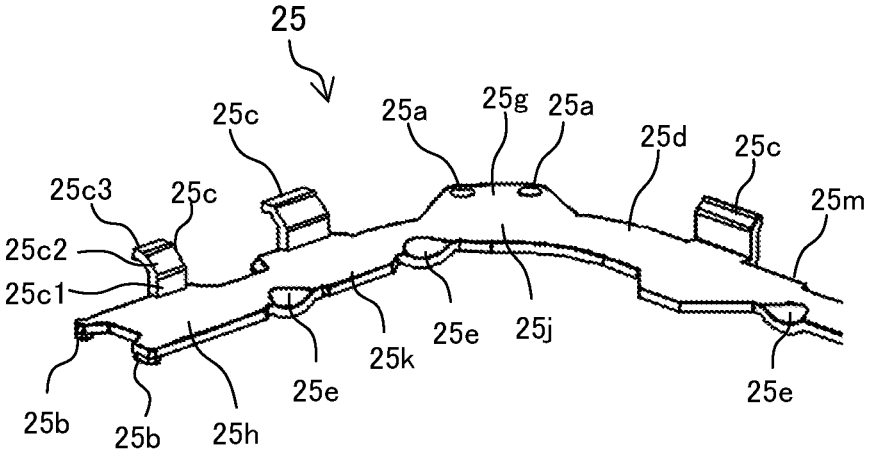
FIG. 7 is an enlarged perspective view of a corner portion of the placement plate of FIG. 6.
Figure 8:
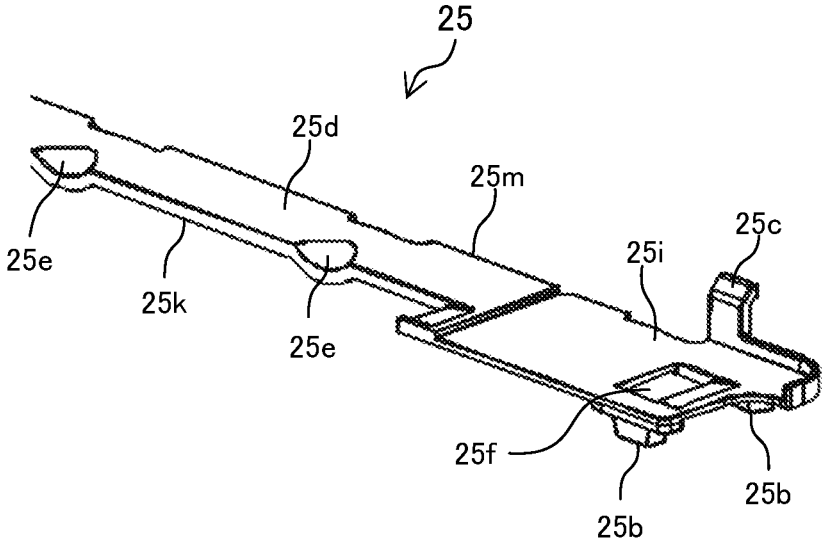
FIG. 8 is an enlarged perspective view of a long-side end portion of the placement plate of FIG. 6.

FIG. 6 is a perspective view of the placement plate 25 having an L-shape in plan view, which is provided on the bottom plate 2. FIG. 7 is an enlarged perspective view in the vicinity of the corner portion 25*j* of the placement plate 25. FIG. 8 is an enlarged perspective view of the vicinity of the long-side end portion 25*i* of the placement plate 25. The placement plate 25 includes two fitting holes 25*a*, leg portions 25*b*, position regulation portions 25*c*, a heat exchanger placement surface 25*d*, drainage leading portions 25*e*, and a drainage opening portion 25*f*. The two fitting holes 25*a* are fitted over the two protruding portions 2*a* (FIG. 5) of the bottom plate 2. The leg portions 25*b* are provided to lower surfaces of the short-side end portion 25*h* and the long-side end portion 25*i*. The position regulation portions 25*c* are configured to regulate a position of the placement plate 25 in a horizontal direction by being brought into contact with the inner surface of the flange portion 2*e* of the bottom plate 2. The heat exchanger placement surface 25*d* receives the heat exchanger 16. The drainage leading portions 25*e* each have a recessed shape for enabling easy drainage of water generated on the heat exchanger placement surface 25*d*. The drainage opening portion 25*f* is an opening for enabling easy drainage of water.

The heat exchanger placement surface 25*d* has an L-shape in plan view, which is similar to the L-shape of the heat exchanger 16. The heat exchanger 16 is placed on the heat exchanger placement surface 25*d* having a planar shape. The heat exchanger placement surface 25*d* does not have a groove portion and a clamping portion, which is configured to clamp and fix the heat exchanger 16 from both sides in a thickness direction of the heat exchanger 16. The fitting holes 25*a* are formed in an extended portion 25*g* being extended outward from the corner portion 25*j* of the heat exchanger placement surface 25*d*. The plurality of drainage leading portions 25*e* are formed at intervals in an end portion 25*k* of the heat exchanger placement surface 25*d* on an inner side in a width direction of the heat exchanger placement surface 25*d*. The drainage leading portions 25*e* each have a recessed shape inclined in a direction toward the bottom plate 2. The drainage leading portions 25*e* are not recessed to positions in contact with the bottom plate 2, and are formed so as to drop the water to the bottom plate 2 from a height position between the placement plate 25 and the bottom plate 2. The heat exchanger placement surface 25*d* has no hole. As a material of the placement plate 25, there may be used resin or metal that is electrically less noble than the heat exchanger 16. Further, the placement plate 25 may be integrally formed.

Figure 9:
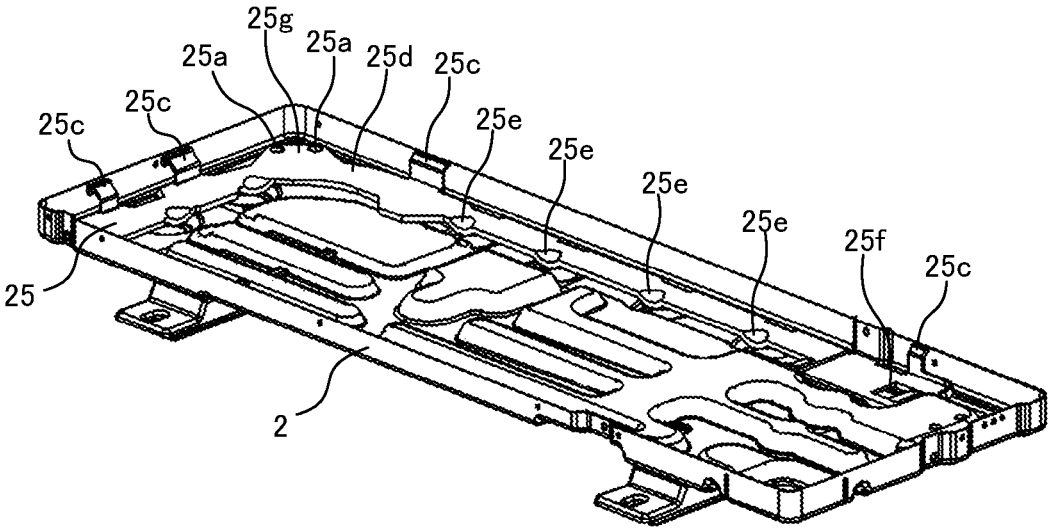
FIG. 9 is a perspective view of the bottom plate to which the placement plate of FIG. 6 is mounted.
Figure 10:
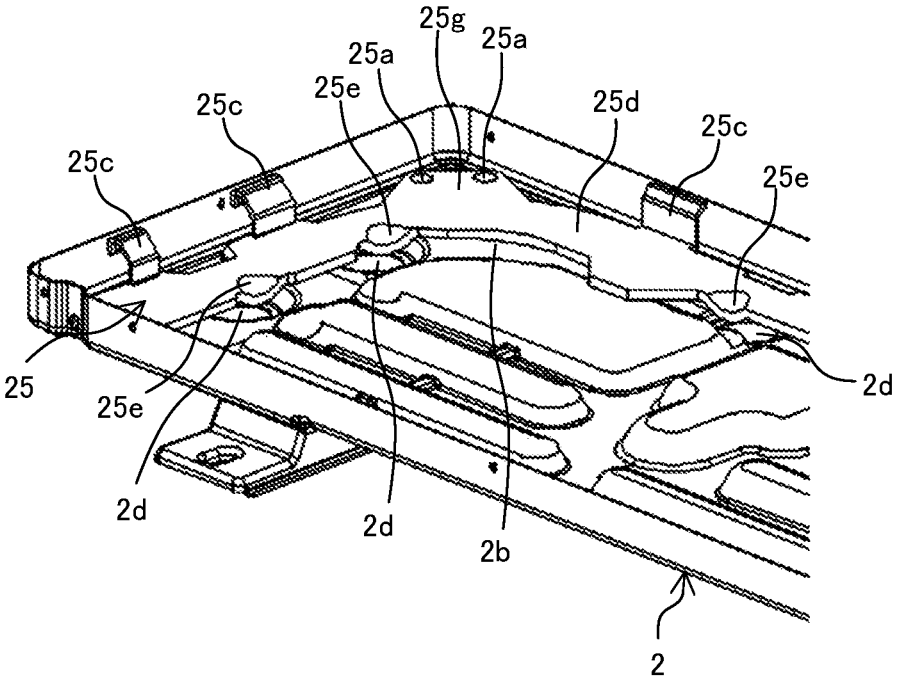
FIG. 10 is an enlarged perspective view for partially illustrating the placement plate and the bottom plate of FIG. 9.
Figure 11:
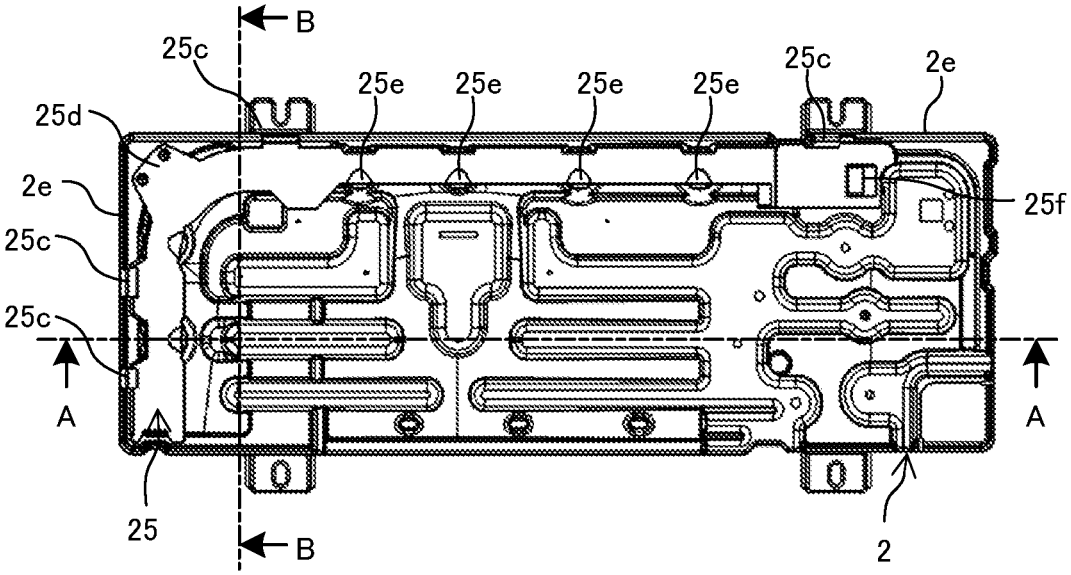
FIG. 11 is a plan view for illustrating the placement plate and the bottom plate of FIG. 9
Figure 12:
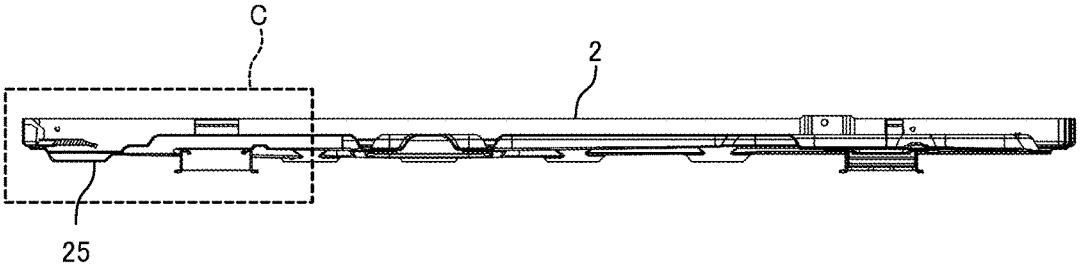
FIG. 12 is a sectional view taken along the chain line A-A of FIG. 9.
Figure 13:
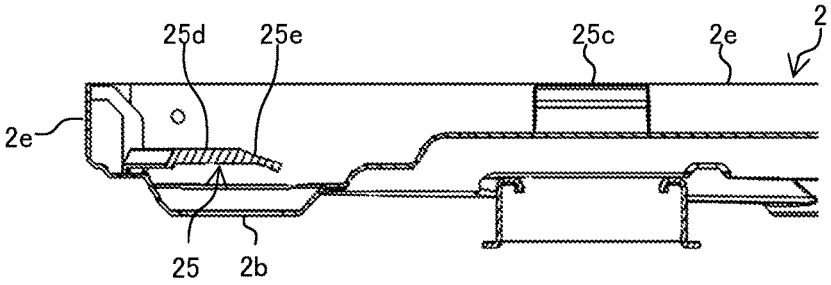
FIG. 13 is an enlarged sectional view for illustrating a portion of FIG. 12, which is surrounded by the frame with the reference symbol C.
Figure 14:
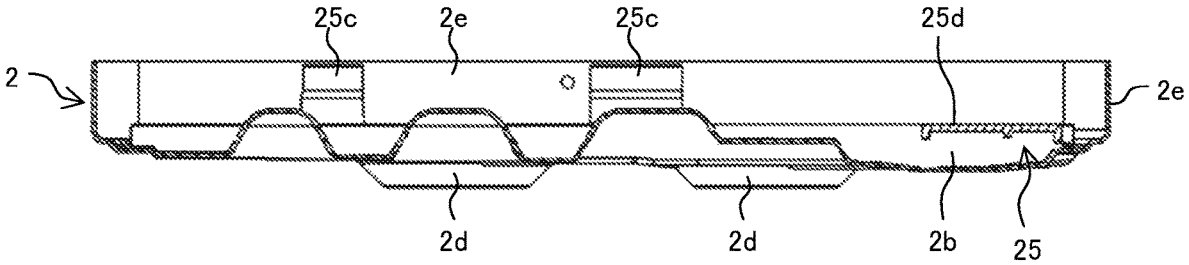
FIG. 14 is a sectional view taken along the chain line B-B of FIG. 9.

FIG. 9 is a perspective view of the bottom plate 2 to which the placement plate 25 is mounted. FIG. 10 is an enlarged perspective view for partially illustrating the bottom plate 2 to which the placement plate 25 is mounted. FIG. 11 is a plan view for illustrating the bottom plate 2 on which the placement plate 25 is provided. FIG. 12 is a sectional view taken along the chain line A-A of FIG. 9. FIG. 13 is an enlarged sectional view for illustrating a portion surrounded by the frame indicated by the chain line with the reference symbol C of FIG. 12. FIG. 14 is a sectional view taken along the chain line B-B of FIG. 9. Although illustration is omitted in FIG. 9 to FIG. 14, the heat exchanger 16 of FIG. 3 is placed on the placement plate 25 (see FIG. 2). The flat tube 20 and the fins 21 of the heat exchanger 16 are partially brought into contact with the placement plate 25. The two fitting holes 25*a* of the placement plate 25 are fitted over the two protruding portions 2*a* formed on the first support portion 2*c*1 of the bottom plate 2.

The placement plate 25 is provided above the discharge passage 2*b* of the bottom plate 2. A lower surface of the short-side end portion 25*h* of the placement plate 25 and a lower surface of the long-side end portion 25*i* of the placement plate 25 each have leg portions 25*b*. The leg portions 25*b* of the short-side end portion 25*h* are placed on the second support portion 2*c*2 of the bottom plate 2. The leg portions 25*b* of the long-side end portion 25*i* are placed on the third support portion 2*c*3 of the bottom plate 2. Contact portions of the placement plate 25 with respect to the bottom plate 2 include only the first support portion 2*c*1, the second support portion 2*c*2, and the third support portion 2*c*3. The second support portion 2*c*2 and the third support portion 2*c*3 are provided at positions higher than the discharge passage 2*b*. The drainage leading portions 25*e* are formed at positions corresponding to the discharge holes 2*d* of the bottom plate 2, that is, above the discharge holes 2*d*. The heat exchanger 16 is fixed by its own weight to the placement plate 25. The protruding portions 2*a* of the bottom plate 2 are fitted to the fitting 25*a* of the placement plate 25. Therefore, the fitting 25*a* do not function as the discharge holes.

A position of the placement plate 25 in the horizontal direction is regulated by the position regulation portions 25*c* provided on the heat exchanger placement surface 25*d*. A plurality of position regulation portions 25*c* are provided at intervals on an end portion 25*m* on an outer side of the heat exchanger placement surface 25*d* in the width direction. The position regulation portions 25*c* are held in contact with an inner surface of the flange portion 2*e* of the bottom plate 2. With this configuration, a horizontal position of the placement plate 25 on the bottom plate 2 is regulated. The position regulation portions 25*c* each have a perpendicular surface 25*c*1, an inclined surface 25*c*2, and a parallel surface 25*c*3. The perpendicular surface 25*c*1 is formed perpendicularly on the heat exchanger placement surface 25*d*. The inclined surface 25*c*2 is formed so as to be continuous with the perpendicular surface 25*c*1 and is formed so as to be inclined with respect to the heat exchanger placement surface 25*d*. The parallel surface 25*c*3 is formed so as to be continuous with the inclined surface 25*c*2 and is formed so as to be parallel with the heat exchanger placement surface 25*d*. During the manufacture of the outdoor unit 100, when the heat exchanger 16 is to be placed on the placement plate 25, a lower surface of the heat exchanger 16 may slide along the inclined surface 25*c*2 so that the heat exchanger 16 may be led to the placement plate 25. Further, a back surface and a left side surface of the heat exchanger 16 may be arranged in contact with the perpendicular surfaces 25*c*1 of the position regulation portions 25*c* so that the position of the heat exchanger 16 in the horizontal direction can be regulated. The side plates 23 and 24 of the heat exchanger 16 are fixed by screws to the casing 1 (FIG. 1) of the outdoor unit 100.

The heat exchanger 16 is placed on the planar heat exchanger placement surface 25*d* of the placement plate 25 provided on the bottom plate 2. With this structure, the heat exchanger 16 and the bottom plate 2 can be prevented from being brought into contact with each other through intermediation of the water and dust generated in the casing 1. In particular, a structure having no member such as a spacer directly below the heat exchanger 16 can be achieved. Therefore, even when the water and dust generated in the casing 1 adhere to the placement plate 25 provided directly below the heat exchanger 16, immediate electrical connection between the heat exchanger 16 and the bottom plate 2 is prevented. Therefore, with the outdoor unit 100 according to this embodiment, the occurrence of the dissimilar metal contact corrosion can be prevented.

The heat exchanger placement surface 25*d* has a planar shape, and does not have a clamping portion, which is configured to clamp the heat exchanger 16 from both sides in the thickness direction of the heat exchanger 16, and a groove portion to which the heat exchanger 16 is fitted. When water and dust are once accumulated in the clamping portion or the groove portion having a structure with, for example, a U-shaped or H-shaped cross section, the water and dust are less likely to be discharged, with the result that the dissimilar metal contact corrosion is liable to be promoted. In contrast, the placement plate 25 of this embodiment has a structure of supporting the heat exchanger 16 from a lower side by a surface, and the clamping portion or the groove portion which may cause difficulty in discharge of water and dust is not provided. Therefore, the following effects can be achieved. That is, even when water or accumulated matters are generated on the placement plate 25, the water and accumulated matters are likely to be discharged to the bottom plate 2, and hence the dissimilar metal contact corrosion is less liable to occur.

Unlike this embodiment, when there is employed a type of fitting the heat exchanger to the placement plate, it is required to prepare a plurality of placement plates in accordance with variation in dimension of the heat exchanger in a depth direction, that is, an array direction in a case of including a plurality of rows. In contrast, in the case of this embodiment, the heat exchanger 16 is placed on the heat exchanger placement surface 25*d* having the planar shape, and hence such a structure can easily deal with the variation of the heat exchanger 16 in the depth direction. That is, the structure can deal with the variation of the heat exchanger 16 by only increasing or reducing the width of the heat exchanger placement surface 25*d* so as to correspond to the dimension of the heat exchanger 16 in the depth direction. When the heat exchanger placement surface 25*d* is formed so as to have a large width, both a heat exchanger having a large dimension in the depth direction and a heat exchanger having a small dimension in the depth direction can commonly use the single placement plate 25.

The placement plate 25 is fixed to the bottom plate 2 by the weight of the heat exchanger 16, and does not require any fixing measure such as fixing by screws. Therefore, there is also an advantage in that disassembly can easily be performed, and hence waste separation at the time of disposal can easily be performed, which gives environmental friendliness. The screws or other members are not used for fixing, and hence the number of components can be reduced. The heat exchanger 16 is fixed by its own weight by only placing the heat exchanger 16 on the heat exchanger placement surface 25*d*. Therefore, the assembly work can easily be performed as compared to related arts in which, unlike this embodiment, the heat exchanger is fitted to the placement plate. Further, it is technically easy to provide the heat exchanger placement surface 25*d* so as to be horizontal with respect to the bottom surface of the bottom plate 2, and hence the heat exchanger 16 is prevented from being mounted with inclination.

The heat exchanger placement surface 25*d* has no hole. With this configuration, even when the discharge holes 2*d* of the bottom plate 2 are closed, and water or dust reversely flows to reach the height position of the placement plate 25, the risk of continuous contact between the heat exchanger 16 and a foreign matter can be reduced, thereby being capable of causing the dissimilar metal contact corrosion be less liable to occur.

The placement plate 25 is provided above the discharge passage 2*b* of the bottom plate 2. With this configuration, the water and dust having dropped from the placement plate 25 can easily be discharged to the outside of the casing 1 while isolating the heat exchanger 16 from the discharge passage 2*b* and preventing contact with the water and dust.

The placement plate 25 includes the heat exchanger placement surface 25*d* having an L-shape in plan view, which is similar to the shape of the heat exchanger 16 having the L-shape in plan view. The heat exchanger 16 is provided within the range of from the short-side end portion 25*h* to the long-side end portion 25*i* of the exchanger placement surface 25*d*. With this configuration, the heat exchanger 16 that is fixed by its own weight to the placement plate 25 can be stably supported. In general, in the outdoor unit 100, the heat exchanger 16 is a second heaviest object comparable to the compressor 14. Therefore, the heat exchanger 16 can be stably supported by supporting not a part of the heat exchanger 16 but an entirety of the heat exchanger 16. Further, the heat exchanger placement surface 25*d* is provided so as to extend along an entirety of the lower surface of the heat exchanger 16. Therefore, even when the water and dust accumulate on the bottom plate 2 provided directly below the heat exchanger 16, and the accumulated matters reach the height position of the placement plate 25, the contact of the accumulated matters to the heat exchanger placement surface 25*d* can be prevented. Thus, the effect of preventing the dissimilar metal contact corrosion can be enhanced.

The fitting holes 25*a* of the placement plate 25 are fitted over the protruding portions 2*a* of the first support portion 2*c*1 provided at positions higher than the discharge passage 2*b* of the bottom plate 2. With this structure, the heat exchanger 16 is provided at a position higher than the discharge passage 2*b*. Thus, the water and dust generated in the casing 1 can be drained to the outside of the casing 1 without causing the water and dust to be brought into contact with the heat exchanger 16. Further, there is formed a space between the heat exchanger 16 and the discharge passage 2*b*. Therefore, even when the discharge holes 2*d* are clogged, and the water and dust reversely flow to the discharge passage 2*b*, the immediate contact between the bottom plate 2 and the heat exchanger 16 through intermediation of the water and dust can be prevented, thereby being capable of preventing occurrence of the dissimilar metal contact corrosion.

Two protruding portions 2*a* are provided to the bottom plate 2, and two fitting holes 25*a* are formed in the placement plate 25. The fitting holes 25*a* are fitted over the protruding portions 2*a*. With this configuration, the placement plate 25 and the heat exchanger 16 are stably fixed on the bottom plate 2 without rotation in the horizontal direction. Therefore, unexpected contact of the heat exchanger 16 and the placement plate 25 with respect to the bottom plate 2 due to the rotation can be prevented.

The fitting holes 25*a* of the placement plate 25 are formed in the extended portion 25*g* being extended outward from the corner portion 25*j* of the heat exchanger placement surface 25*d* having an L-shape in plan view. With this configuration, even when the water and dust are accumulated in the fitting holes 25*a* in which the water and dust are liable to accumulate as compared to the planar heat exchanger placement surface 25*d*, the contact between the heat exchanger 16 and the bottom plate 2 through intermediation of the accumulated matters can be prevented.

The placement plate 25 is held in contact with the bottom plate 2 only below the short-side end portion 25*h*, the long-side end portion 25*i*, and the corner portion 25*j* of the heat exchanger placement surface 25*d* having the L-shape in plan view. With this configuration, there are less contact portions between the placement plate 25 and the bottom plate 2, and hence the placement plate 25 does not hinder the flow of water and dust on the discharge passage 2*b*. Therefore, the water and dust can smoothly be discharged to the outside of the casing 1, thereby being capable of enhancing the effect of preventing the dissimilar metal contact corrosion.

The leg portions 25*b* are provided to the lower surfaces of the short-side end portion 25*h* and the long-side end portion 25*i* of the heat exchanger placement surface 25*d*. The leg portions 25*b* are placed on the second support portion 2*c*2 and the third support portion 2*c*3 of the bottom plate 2. With this configuration, the contact area between the placement plate 25 and the bottom plate 2 can be reduced, and the distance between the placement plate 25 and the discharge passage 2*b* can be increased. Therefore, the effect of causing the water and dust on the bottom plate 2 to be less liable to be brought into contact with the placement plate 25 can be enhanced.

At the end portion 25*k* on the inner side of the heat exchanger placement surface 25*d* in the width direction, the plurality of drainage leading portions 25*e* each having a recessed shape for causing the water generated on the placement plate 25 to drop to the bottom plate 2 are formed at intervals. The drainage leading portions 25*e* are not recessed to positions in contact with the bottom plate 2, and are formed so as to cause the water to drop from a height position between the placement plate 25 and the bottom plate 2. With this configuration, the water generated on the placement plate 25 can easily be dropped to the bottom plate 2, and the placement plate 25 is not continuously held in contact with the water having dropped on the bottom plate 2, thereby being capable of enhancing the effect of preventing the dissimilar metal contact corrosion. The drainage opening portion 25*f* also has the effect of causing the water on the placement plate 25 to be easily dropped to the bottom plate 2.

The drainage leading portions 25*e* are formed at positions corresponding to the discharge holes 2*d* formed in the discharge passage 2*b* of the bottom plate 2, that is, directly above the discharge holes 2*d*. With this configuration, the water having dropped from the drainage leading portion 25*e* to the bottom plate 2 can directly be drained through the discharge holes 2*d*. Therefore, the stagnation of water in the casing 1 is eliminated, thereby being capable of enhancing the effect of preventing the dissimilar metal contact corrosion.

The positional regulation for the placement plate 25 in the horizontal direction is performed by the position regulation portions 25*c* each having a protruding shape and being provided on the placement plate 25. The position regulation portions 25*c* are applied to the inner surface of the flange portion 2*e* of the bottom plate 2. With those position regulation portions 25*c*, the position of the placement plate 25 in the horizontal direction on the bottom plate 2 is determined, thereby being capable of stably fixing the placement plate 25 and the heat exchanger 16.

The position regulation portions 25*c* have inclined surfaces 25*c*2. With this configuration, during the manufacture of the outdoor unit 100, when the heat exchanger 16 is to be mounted to the placement plate 25, the lower surface of the heat exchanger 16 may slide along the inclined surface 25*c*2 so that the heat exchanger 16 may be led to the bottom plate 2. With this configuration, the operation of mounting the heat exchanger 16 to the bottom plate 2 can easily be performed, thereby being capable of shortening the manufacture time and reducing the cost.

The placement plate 25 may be integrally formed. With the integrated structure, the number of components is reduced, thereby being capable of reducing the assembly time for the outdoor unit 100. Further, the integral formation may increase the strength of the placement plate 25, thereby being capable of mounting the heat exchanger 16 to the placement plate 25 more stably.

Resin may be used as a material of the placement plate 25. Even when the mixture of water and dust is accumulated on the bottom plate 2 provided directly below the heat exchanger 16 and reaches the height position of the placement plate 25, the placement plate 25 made of resin electrically insulates the bottom plate 2 and the heat exchanger 16 from each other, thereby being capable of preventing occurrence of the dissimilar metal contact corrosion.

The configuration of this embodiment is particularly effective when the heat exchanger 16 is a heat exchanger using aluminum as a material of each of the flat tube 20 and the fins 21. As a material of the bottom plate 2, there may be used an iron plate or a zinc-coated steel plate. In the case of the combination of those materials, the metal constructing the heat exchanger 16 is electrically less noble than the material constructing the bottom plate 2. Therefore, when the heat exchanger 16 and the bottom plate 2 are electrically connected to each other through intermediation of accumulated matters such as water and dust generated in the casing 1, the corrosion caused by the dissimilar metal contact may occur. However, with the configuration of the outdoor unit 100 of this embodiment, as described above, the contact between the heat exchanger 16 and the bottom plate 2 through intermediation of accumulated matters such as water and dust can be prevented. Therefore, even when the heat exchanger 16 is a heat exchanger made of aluminum, the dissimilar metal contact corrosion can be prevented.

The casing 1 of the outdoor unit 100 of this embodiment includes the bottom plate 2 and various panels 3 to 8. However, it is only necessary that the air-sending machine chamber 9 and the machine chamber 10 be formed in the casing 1, and the configuration is not limited to the configuration of the casing 1 of this embodiment. For example, a right side panel being capable of entirely covering the right side may be provided, and the service panel 4 and the cover panel 7 may be omitted. Further, in this embodiment, the two protruding portions 2*a* are provided to the bottom plate 2, and the two fitting holes 25*a* are formed in the placement plate 25. However, three protruding portions 2*a* and three fitting holes 25*a* may also be employed. Further, in this embodiment, the plurality of drainage leading portions 25*e* are formed. However, only one drainage leading portion 25*e* may be formed. Further, in this embodiment, the placement plate 25 is held in contact with only the first support portion 2*c*1, the second support portion 2*c*2, and the third support portion 2*c*3 on the bottom plate 2. However, for example, in accordance with need for reinforcement, the placement plate 25 may suitably be held in contact with portions of the bottom plate 2 other than the support portions 2*c*1 to 2*c*3. Further, in this embodiment, the two position regulation portions 25*c* are provided to each of the long side and the short side of the heat exchanger placement surface 25*d*. However, not limited to this configuration, it is only necessary that at least one position regulation portion 25*c* be provided to each of the long side and the short side. Further, in this embodiment, the second support portion 2*c*2 and the third support portion 2*c*3 are provided at positions higher than the discharge passage 2*b*. However, the second support portion 2*c*2 and the third support portion 2*c*3 may be provided at height positions equal to the height position of the discharge passage 2*b*. Even when the second support portion 2*c*2 and the third support portion 2*c*3 are provided at height positions equal to the height position of the discharge_ passage 2*b*, there may be formed the space between the placement plate 25 and the discharge passage 2*b* by providing the leg portions 25*b*, thereby being capable of preventing the contact between the heat exchanger 16 and the bottom plate 2 through intermediation of the water and dust generated in the casing 1.

The invention claimed is:

1. An outdoor unit for an air-conditioning apparatus, comprising:

a bottom plate made of metal;

a heat exchanger made of metal different than the metal of the bottom plate, the heat exchanger having an L-shape in plan view; and a placement plate provided on the bottom plate and having a heat exchanger placement surface on which the heat exchanger is placed, the placement plate having an L-shape in plan view, wherein the placement plate is held in contact with the bottom plate only below each of a short-side end portion of the placement plate, a long-side end portion of the placement plate, and a corner portion of the placement plate.

2. The outdoor unit for an air-conditioning apparatus of claim 1, wherein a groove portion to which the heat exchanger is fitted is not provided on the heat exchanger placement surface.

3. The outdoor unit for an air-conditioning apparatus of claim 1, wherein a hole is not provided on the heat exchanger placement surface.

4. The outdoor unit for an air-conditioning apparatus of claim 1, wherein the placement plate is provided above a discharge passage provided on the bottom plate.

5. The outdoor unit for an air-conditioning apparatus of claim 4, wherein the bottom plate has a protruding portion provided at a position higher than the discharge passage, and wherein the placement plate has a fitting hole, and the fitting hole is fitted over the protruding portion.

6. The outdoor unit for an air-conditioning apparatus of claim 5, wherein the protruding portion comprises two protruding portions, and the fitting hole comprises two fitting holes.

7. The outdoor unit for an air-conditioning apparatus of claim 5, wherein the fitting hole is formed in an extended portion being extended outward from the corner portion of the heat exchanger placement surface.

8. The outdoor unit for an air-conditioning apparatus of claim 4, wherein the heat exchanger placement surface has a drainage leading portion having a shape recessed to a height position between the bottom plate and the placement plate, wherein the discharge passage has a discharge hole, and wherein the drainage leading portion is formed above the discharge hole.

9. The outdoor unit for an air-conditioning apparatus of claim 8, wherein the placement plate is provided above the discharge hole formed on the bottom plate.

10. The outdoor unit for an air-conditioning apparatus of claim 1, wherein the placement plate includes a leg portion provided on a lower surface of each of the short-side end portion of the placement plate and the long-side end portion of the placement plate of the heat exchanger placement surface, and wherein the leg portion is placed on the bottom plate.

11. The outdoor unit for an air-conditioning apparatus of claim 1, wherein the heat exchanger placement surface has a drainage leading portion having a shape recessed to a height position between the bottom plate and the placement plate.

12. The outdoor unit for an air-conditioning apparatus of claim 1, wherein the bottom plate has a flange portion extending along a peripheral edge of the bottom plate and has an inner surface perpendicular to a bottom surface of the bottom plate, wherein the placement plate has a position regulation portion having a protruding shape, and wherein the position regulation portion is held in contact with the inner surface of the flange portion.

13. The outdoor unit for an air-conditioning apparatus of claim 12, wherein the position regulation portion comprises:

a perpendicular surface formed perpendicularly on the heat exchanger placement surface;

an inclined surface formed to be continuous with the perpendicular surface and formed to be inclined with respect to the heat exchanger placement surface; and a parallel surface formed to be continuous with the inclined surface and formed to be parallel to the heat exchanger placement surface.

14. The outdoor unit for an air-conditioning apparatus of claim 1, wherein the placement plate is integrally formed.

15. The outdoor unit for an air-conditioning apparatus of claim 1, wherein a material of the placement plate is resin.

16. The outdoor unit for an air-conditioning apparatus of claim 1, wherein a metal material of the heat exchanger is electrically less noble than a metal material of the bottom plate.

17. The outdoor unit for an air-conditioning apparatus of claim 16, wherein the metal material of the heat exchanger is aluminum, and wherein the metal material of the bottom plate is iron.

* * * * *